US005607106A

United States Patent [19]

Bentz et al.

[11] Patent Number: 5,607,106

[45] Date of Patent: Mar. 4, 1997

[54] LOW INERTIA, WEAR-RESISTANT VALVE FOR ENGINE FUEL INJECTION SYSTEMS

[75] Inventors: Joseph C. Bentz; John T. Carroll, III; Lester L. Peters; Thomas M. Yonushonis, all of Columbus; Jeffrey L. Campbell, Hope, all of Ind.

[73] Assignees: Cummins Engine Company, Columbus, Ind.; Toshiba Corporation, Tokyo, Japan

[21] Appl. No.: 288,047

[22] Filed: Aug. 10, 1994

[51] Int. Cl.[6] ..... F02M 47/02

[52] U.S. Cl. ..... 239/88; 239/533.3; 239/DIG. 19

[58] Field of Search ..... 239/88, 533.3, 239/DIG. 19

[56] References Cited

U.S. PATENT DOCUMENTS

| | | | |
|---|---|---|---|
| 4,266,729 | 5/1981 | Kulke et al. | 239/533.12 |
| 4,544,096 | 10/1985 | Burnett | 239/88 X |
| 4,962,887 | 10/1990 | Matsuoka | 239/95 |
| 5,076,244 | 12/1991 | Donaldson | 123/527 |
| 5,095,872 | 3/1992 | Kawamura | 123/254 |
| 5,409,165 | 4/1995 | Carroll, III et al. | 239/DIG. 19 X |

FOREIGN PATENT DOCUMENTS

| | | | |
|---|---|---|---|
| 58-143161 | 8/1983 | Japan | 239/533.3 |
| 4-103871 | 4/1992 | Japan | 239/DIG. 19 |
| 5-240126 | 9/1993 | Japan | 239/88 |
| 5-240128 | 9/1993 | Japan | 239/88 |
| 6-50241 | 2/1994 | Japan . | |

*Primary Examiner*—Andres Kashnikow
*Assistant Examiner*—Lesley D. Morris
*Attorney, Agent, or Firm*—Sixbey, Friedman, Leedom & Ferguson

[57] ABSTRACT

A low inertia, wear-resistant needle valve assembly is provided for an internal combustion engine closed nozzle unit fuel injector. The needle valve assembly includes a needle and spring retainer subassembly made from an advanced structural ceramic, such as silicon nitride. A valve seat subassembly in the injector cup is made from a combination of metal and ceramic. The assembly materials and configuration provide maximum control over the efficiency of the injection event so that the fuel injection event can be terminated quickly, thereby allowing more effective control over exhaust emissions.

12 Claims, 6 Drawing Sheets

LOW INERTIA, WEAR-RESISTANT VALVE FOR ENGINE FUEL INJECTION SYSTEMS

TECHNICAL FIELD

The present invention relates generally to valves for internal combustion engine closed nozzle fuel injectors and specifically to a low inertia, wear-resistant valve for a closed nozzle fuel injector capable of quickly terminating an injection event.

BACKGROUND OF THE INVENTION

Closed nozzle fuel injectors present specifically defined system dynamics which must be addressed to provide the maximum control possible over the efficiency of the injection event. If the injection event can be terminated quickly, a significant reduction in the amount of fuel delivered to the combustion chamber after injection pressure has dropped below an ideal level can be achieved. This reduction of fuel will measurably reduce exhaust particulates and other products of incomplete combustion.

The prior art has suggested a variety of approaches both to increase the efficiency of the fuel injection event and to improve the longevity and functioning of the fuel injector components. For example, U.S. Pat. No. 4,962,887 to Matsuoka discloses an accumulator fuel injection system which shortens the fuel injection time and increases the fuel injection rate with a control valve that controls accumulator pressure relative to a needle valve closing pressure. It is not suggested, however, that the needle or any of the valve components could be formed of a low inertia or wear-resistant material to have a structure or a mass which will enable an injection event to be more quickly terminated.

U.S. Pat. No. 5,095,872 to Kawamura discloses an engine fuel injection nozzle and needle valve made of a ceramic material. These fuel injection components are designed for use with an engine fueled by alcohol, however, and must be made of a high heat and alcohol-resistant ceramic to optimize combustion of the alcohol and air mixture in the combustion chamber and to avoid overheating of the fuel injection nozzle, although it is suggested that problems with sliding motion are addressed by forming the fuel injection nozzle of ceramic. U.S. Pat. No. 5,076,244 to Donaldson also discloses forming a fuel injection nozzle of a ceramic material. However, an insulating thermal shock resistant ceramic is required for this injector apparatus which is used in an engine fueled by liquified petroleum gas.

U.S. Pat. No. 4,266,729 to Kulke et al. discloses a fuel injection valve with a nozzle needle. An independent needle tip is secured at one end to the nozzle needle, and the other end of the needle tip protrudes through an ejection opening formed within a disc secured to the injector nozzle body. The needle tip and/or the disc are described to be made of corrosion-resistant material, such as high quality steel, ceramic or industrial glass. The use of a corrosion-resistant material to form the needle tip and/or disc is stated to prevent corrosion of these structures and to avoid constriction of the injection opening.

Although the prior art discloses the use of various ceramic components in fuel injector valves, the prior art does not suggest a low inertia, wear-resistant fuel injector valve including a needle valve and spring retainer assembly including ceramic components with a combined mass which improves fuel injector dynamic characteristics. A need exists for such a low inertia, wear-resistant fuel injector valve for a closed nozzle unit fuel injector in a diesel internal combustion engine.

SUMMARY OF THE INVENTION

It is a primary object of the present invention, therefore, to overcome the disadvantages of the prior art and to provide a low inertia, wear-resistant fuel injection valve for a closed nozzle unit fuel injector for a diesel internal combustion engine.

It is another object of the present invention to provide a needle valve and spring retainer assembly for a closed nozzle fuel injector which advances the termination of the injection event.

It is a further object of the present invention to provide a closed nozzle fuel injector valve with improved needle valve responsiveness.

It is yet another object of the present invention to provide a closed nozzle fuel injector valve which reduces regulated exhaust emissions, including particulates and other products of incomplete combustion.

It is yet a further object of the present invention to provide a valve for a closed nozzle fuel injector with improved wear resistance at the needle valve seat and bore.

It is still another object of the present invention to provide a valve assembly for a closed nozzle fuel injector including components with a combined mass which quickly terminates a fuel injection event.

The aforesaid objects are achieved by providing a closed nozzle unit fuel injector for an internal combustion engine including a needle valve assembly which is stronger, better able to adapt to differences in thermal expansion, and has improved injector dynamic characteristics. The needle valve assembly is positioned within the injector body and adjacent to the fuel injection nozzle tip. The needle valve assembly includes a seat subassembly proximate to the injector tip in the cup area of the injector with a metal section and a ceramic section spaced inwardly from the metal section and away from the tip. The needle valve assembly is positioned in a central axial bore which provides a fluid communication channel between the engine fuel supply and the combustion chamber external to the injector tip. The needle valve assembly further includes a needle and spring retainer subassembly. This subassembly includes a needle and retainer formed of a ceramic material and a spring formed of metal. The combined mass of the needle and spring retainer subassembly improves fuel injector dynamic characteristics.

Other objects and advantages will be apparent from the following description, claims and drawings.

DESCRIPTION OF THE PREFERRED EMBODIMENTS

The present invention is directed to an improvement in fuel injection technology. Closed nozzle fuel injectors present different fuel delivery problems and considerations for solving those problems than open nozzle fuel injectors. Improvements in injector fuel delivery produces improvements in the reduction of engine exhaust particulate materials and other products of incomplete combustion. Because particulate and other exhaust emissions cannot usually be satisfactorily controlled after the injection pressure has dropped below an ideal level, significant improvements in fuel delivery and emission particulates can be achieved when the fuel injection event is terminated quickly. Optimally, the fuel injection event should be terminated by the time the injection pressure has dropped to this level. The closed nozzle fuel injector needle valve and retainer assembly of the present invention allows the injection event to be terminated about one degree of crank angle sooner than is currently possible with available needle valve and retainer assemblies. This quicker end of injection reduces by about 20% the volume of fuel delivered to the combustion chamber after injection pressure has dropped below the ideal level. As a result, exhaust particulates and other products of incomplete combustion will be measurably reduced.

Closed nozzle fuel injector needle valves and associated structures currently in use are made from various kinds of steel. The injector needle valve and associated structures of the present invention are made from a high strength, wear-resistant advanced ceramic material, such as silicon nitride. The density of silicon nitride is less than one-half of the density of steel. Moreover, the tribological benefits of silicon nitride in sliding or bearing contact with ferrous metals have been well established. The combined mass of the injector needle valve, spring and spring retainer limits the speed with which a fuel injection event can be terminated once injection pressure has dropped below a level where particulate and other exhaust emissions are satisfactorily controlled. Therefore, the needle valve assembly of the present invention with its lower mass and density than the conventionally used steel needle valve components is able to terminate an injection event more quickly.

Figures 1, 1A:
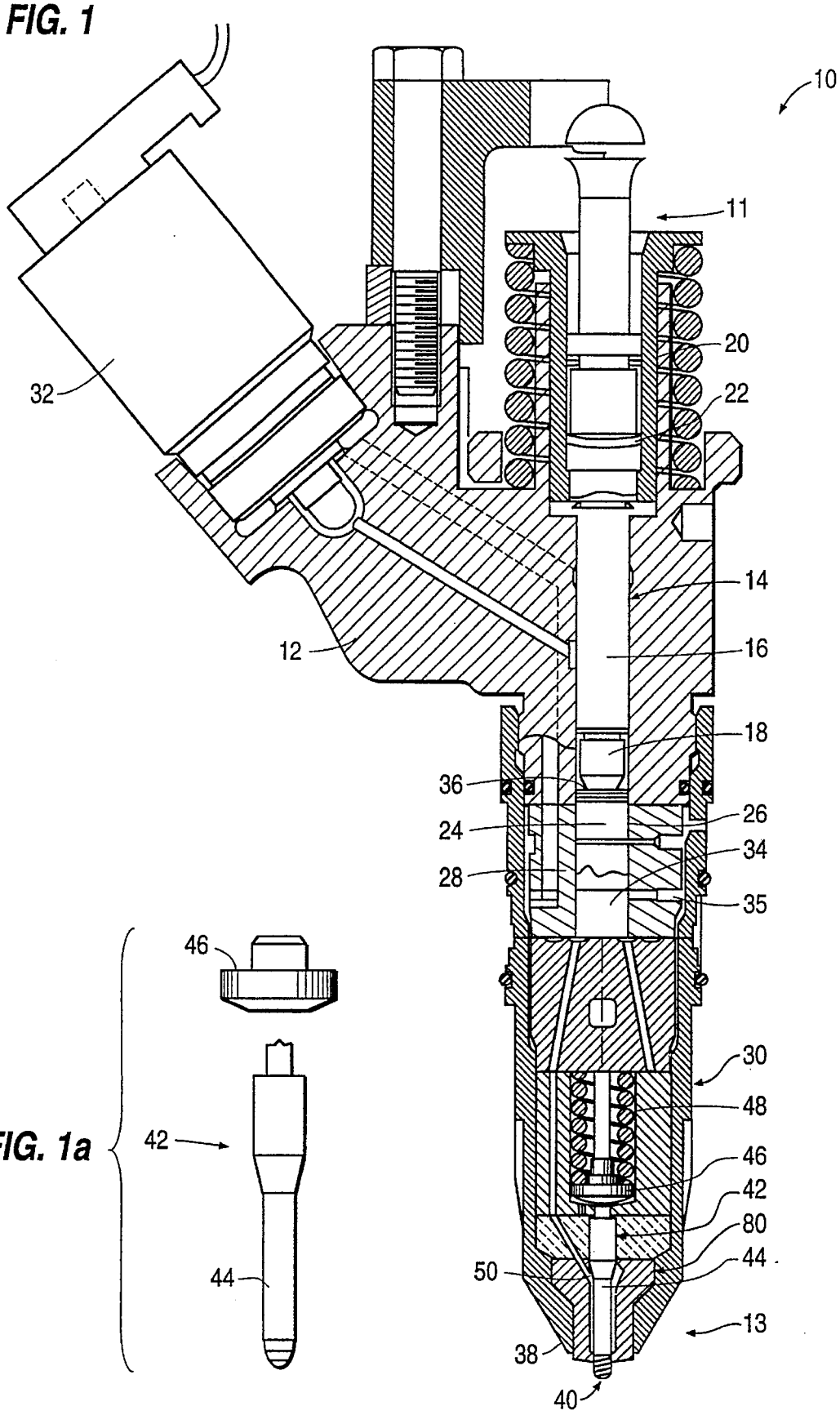
FIG. 1 is a cross-sectional view of a closed nozzle fuel injector showing the needle valve assembly of the present invention, with an enlarged view of the needle and retainer element.

Referring to the drawings, FIG. 1 illustrates a closed nozzle fuel injector with the ceramic needle, valve seat and spring retainer element of the present invention in place. The unit fuel injector 10 shown in FIG. 1 is a closed nozzle electronic fuel injector of the type described in U.S. Pat. No. 5,067,464 to Rix et al. and owned by the assignee of the present invention. The disclosure of U.S. Pat. No. 5,067,464 is hereby incorporated herein by reference.

The injector body 12, which may be formed as a forged unit, includes a central axial cavity 14 that extends throughout the length of the injector body 12 from the link end 11 of the injector that is linked to actuating structure (not shown) toward the nozzle or tip end 13 of the injector where fuel is discharged. The axial cavity 14 includes two coaxial and communicating central bores of differing inner diameters. The first cylindrical bore 16 slidingly receives a timing plunger 18, while the second cylindrical bore 20, which is larger in diameter than bore 16, and is positioned between the bore 16 and the link end 11, slidingly receives a coupling member 22. A metering plunger 24 is slidingly received in a cylindrical bore 26 formed in a metering barrel 28 located between the bore 16 and the tip end 13. A nozzle assembly 30 is connected to the injector body 12 adjacent to the metering barrel 28. A control solenoid 32 is actuated to supply fuel to a metering chamber 34 associated with the injector metering plunger 24 so that a precisely determined quantity of fuel will be injected into the engine cylinder or combustion chamber (not shown). A metering spill port 35 is provided to allow excess fuel to flow from the metering chamber 34 and return to the fuel supply (not shown).

At a predetermined crankshaft angle, the injection sequence begins. The control solenoid 32 is deactivated, which prevents the backflow of fuel out of the timing chamber 36 formed between the timing plunger 18 and the metering plunger 24 and forms a hydraulic link between the plungers 18 and 24. As the load transferred from the engine camshaft (not shown) and mechanical linkage structures (not shown) to the injector structures increases against the contained hydraulic reservoirs created between the timing and metering plungers 18 and 24, the pressure in these reservoirs increases until a preset injection initiation pressure is reached. Injection initiation pressures are typically preset at about 5,000 psi. When this injection initiation pressure is reached, the normally closed fuel injection nozzle 38 is opened, and fuel is injected through spray holes at 40 in the nozzle tip into the cylinder or other combustion chamber. The pressure increases as injection continues and may exceed 20,000 psi.

Figure 3:
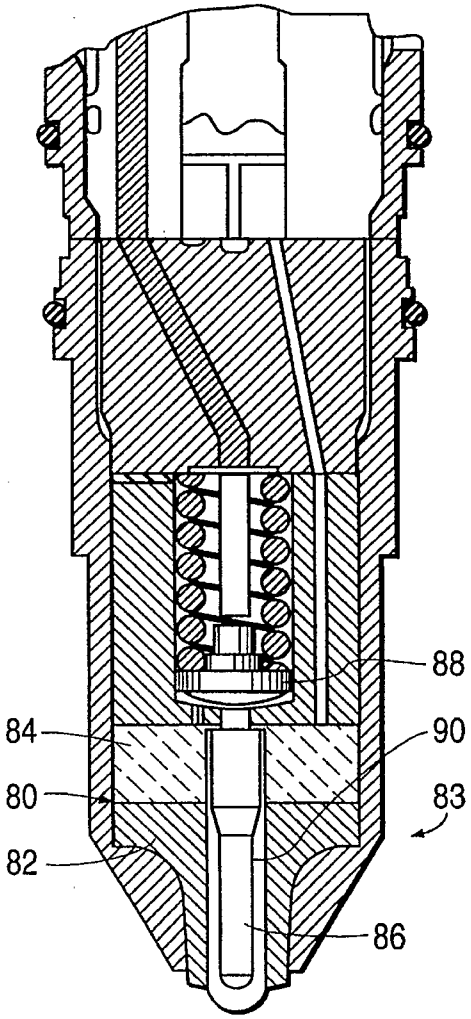
FIG. 3 illustrates a valve seat subassembly of the needle valve assembly of the present invention.

The exertion of the predetermined injection initiation pressure on the components of the nozzle assembly 30 actually causes the normally closed nozzle 38 to open and the fuel to be injected. The nozzle assembly 30 includes a needle valve subassembly 42, which is shown enlarged in the block in FIG. 1. The needle valve subassembly includes a needle valve 44 and a retainer element 46 which contacts the needle valve 44 during fuel injection. A seat subassembly 80, which is described in detail in connection with FIG. 3, is located in the tip end 13 or cup of the injector. The retainer element 46 is engaged by a spring 48, which normally biases the needle valve 44 toward the tip end 13 of the injector so that it is seated in a suitably configured seat in the injector nozzle 38. When the injection initiation pressure is exceeded, this also overcomes the biasing force of spring 48 and causes the needle valve subassembly 42 to become unseated so that the fuel which has entered the chamber 50 about the needle valve 44 is injected through spray holes at 40 as the needle is unseated and the closed nozzle is opened.

At the end of the injection event, pressure is relieved in the metering chamber 34, and fuel is selectively transported to the fuel supply through the spill port 35. The pressure in chamber 34 rapidly drops when fuel flows through the spill port 35, which allows the nozzle to close as the needle valve 44 is seated. This positively terminates the injection event. The present invention allows the use of a larger spill port than has been used heretofore, which quickly terminates the injection event.

It has been determined that the combined mass of the needle valve 44, retainer element 46 and spring 48 limits how quickly a fuel injection event can be terminated once injection pressure has dropped below a level where particulate and other exhaust emissions are satisfactorily controlled. It has been demonstrated that an injection event can be terminated one degree of crank angle sooner if the inertia of the materials forming the needle valve 44 and retainer element 46 is lower than that of the steel currently used to form these components. Reducing the time required to terminate injection reduces the volume of fuel delivered to the combustion chamber after injection pressure has dropped below an ideal level by twenty (20) percent. Such a reduction significantly reduces exhaust particulates and other products of incomplete combustion. The present invention employs a low inertia, ceramic material, preferably a silicon nitride, to form the needle valve 44 and retainer element 46. As a result, needle valve responsiveness is improved, regulated exhaust emissions are reduced, and the wear resistance of these structures and, hence, the unit injector is improved.

The present invention provides a low inertia needle valve subassembly for a closed nozzle unit fuel injector that includes a needle valve and spring retainer element made from a high strength, wear resistant advanced ceramic material with a density that is substantially lower than the density of the materials, generally steels, conventionally used to form fuel injector needle valve components. Silicon nitride, which is the ceramic material preferred for this purpose, has a density that is less than half of the density of the steels currently used. Moreover, the tribological benefits of silicon nitride in sliding or bearing contact of silicon nitride with metals not only make it an ideal material for the valve of the present invention, but produce unexpected injector performance.

Figure 2B:
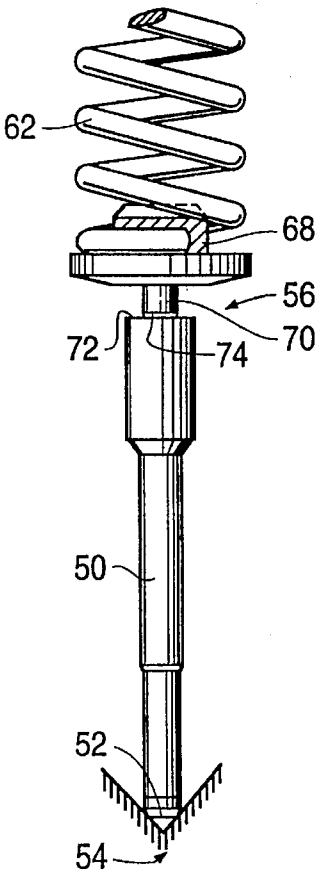
FIGS. 2*a* and 2*b* are schematic illustrations which show two embodiments of needle and spring retainer subassemblies of the needle valve assembly of the present invention.
Figure 2A:
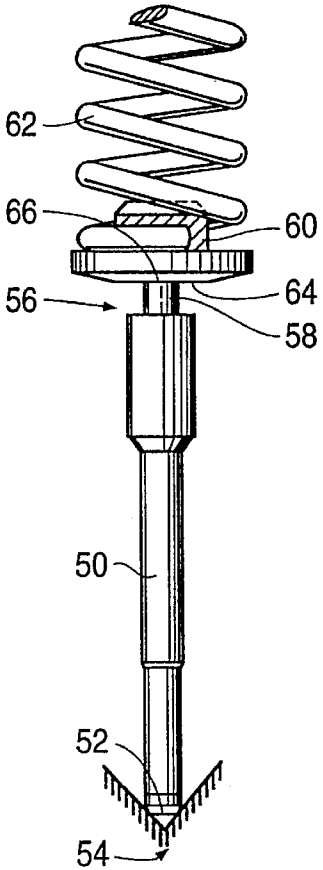

FIGS. 2*a* and 2*b* illustrate two configurations of a needle valve assembly in accordance with the present invention. Both assemblies include a needle 51 made from an advanced ceramic material with a tip 52 that is configured to seat in the cup of a unit fuel injector (not shown in FIG. 2). The end 56 of the needle 51 that is opposite the tip end preferably has one of the two configurations shown in FIGS. 2*a* and 2*b*. The FIG. 2*a* configuration is formed to include an integral projection or nib 58. A retainer element 60, also made from an advanced structural ceramic, is received within the coil of a helical biasing spring 62, which biases the needle in a seated position toward the injector tip as discussed above in connection with FIG. 1. The spring 62 is preferably made of steel. The retainer element 60 has a planar contact surface 64 which contacts the surface 66 of the nib 58 during each injection event.

The needle valve assembly configuration shown in FIG. 2*b* includes a retainer element 68 with an integrally formed depending nib 70. The end 56 of the needle 50 then has a planar contact surface 72. The correspondingly planar surface 74 on the nib 70 then contacts the needle contact surface 72 during each injection event. The arrangement shown in FIG. 2*b* may present a slight strength advantage over that shown in FIG. 2*a* because the nib 70 does not reciprocate with the needle 51.

Because the fuel injector needle valve components of the present invention are made of a structural ceramic, such as silicon nitride, and the surrounding fuel injector components are made of a metal, typically steel, that has different thermal expansion properties than structural ceramics, some modification of the injector cup area might be required to insure that the needle is seated securely in the injector cup and that there is no leakage between the needle and cup bore. One modification of the injector cup structure which will seat the needle and eliminate leakage due to the differences in thermal expansion of the components in this area is the seat subassembly 80 shown in FIG. 3. The seat subassembly 80 shown in FIG. 3 is located in the injector cup area 83 and includes a stainless steel portion 82 and a ceramic portion 84. The ceramic needle 86 and retainer element 88 reciprocate within chamber 90 in both the ceramic portion 84 and stainless steel portion 82 of the cup during each injection event so that the effects of the differential thermal expansion of the dissimilar materials are minimized.

Figure 4A:
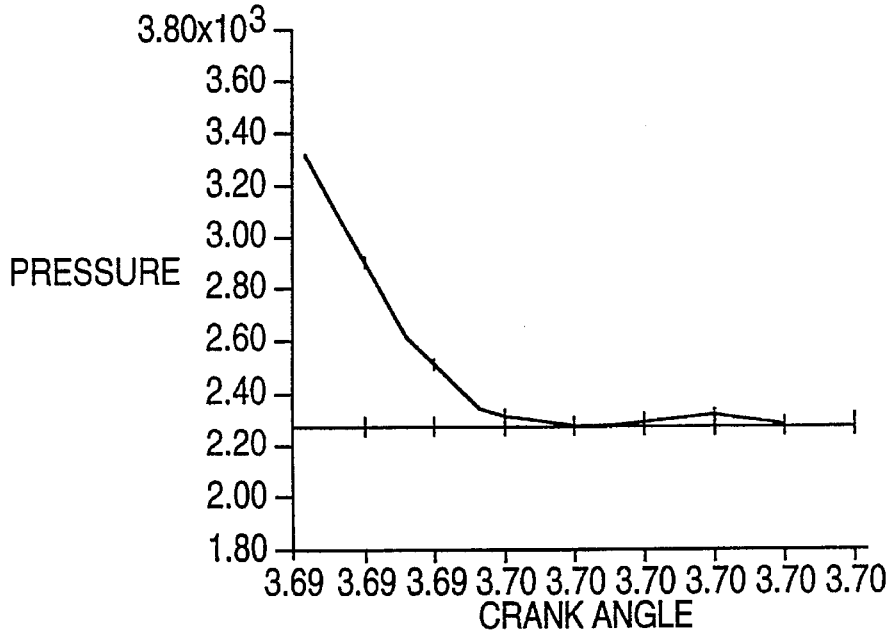
FIGS. 4*a*, 4*b*, 4*c*, 4*d*, 4*e* and 4*f* present graphically, a comparison of the pressure and injection rate at different crank angles for a currently available needle valve and spring retainer assembly and for a reduced mass valve and spring retainer assembly according to the present invention at two different spill port diameters.
Figure 4B:
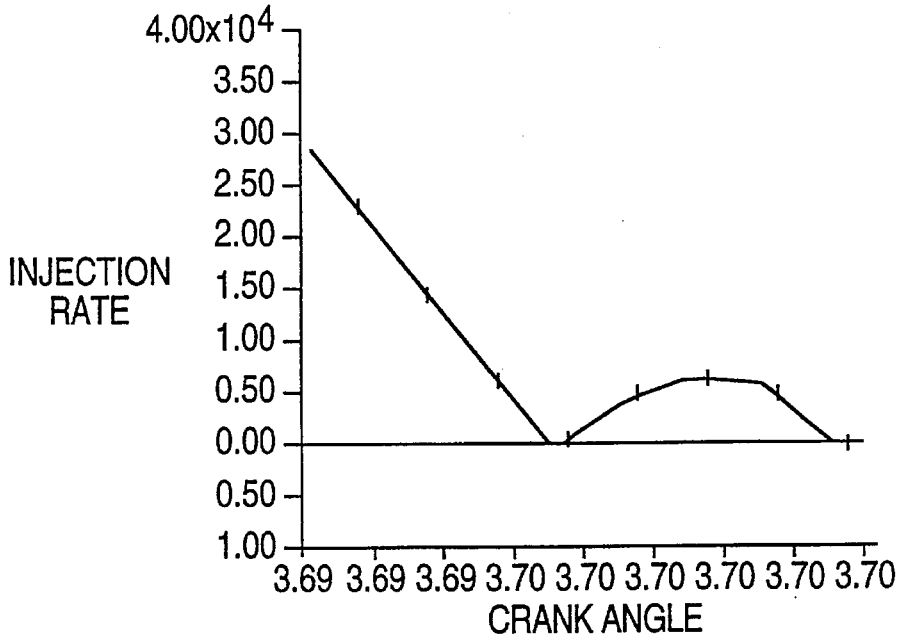
Figure 4C:
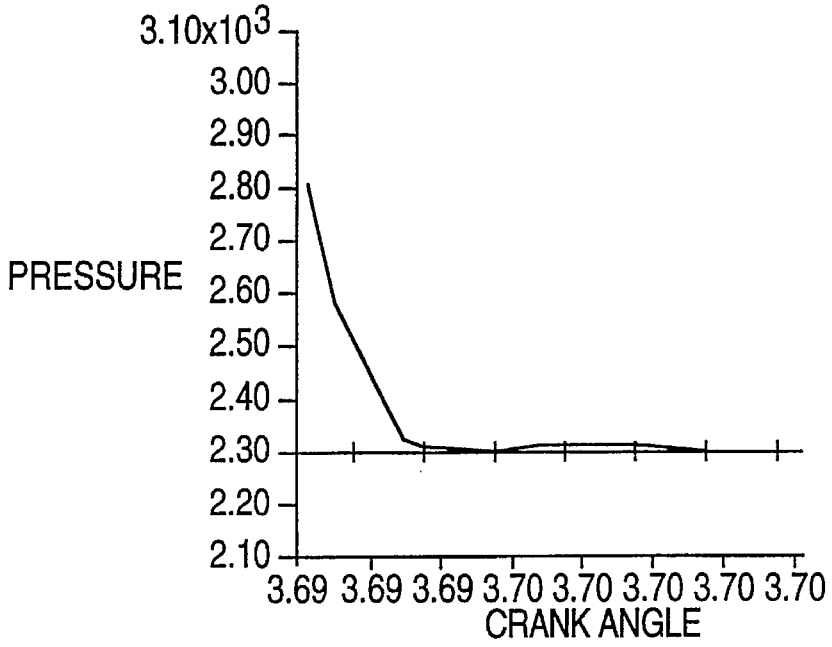
Figure 4D:
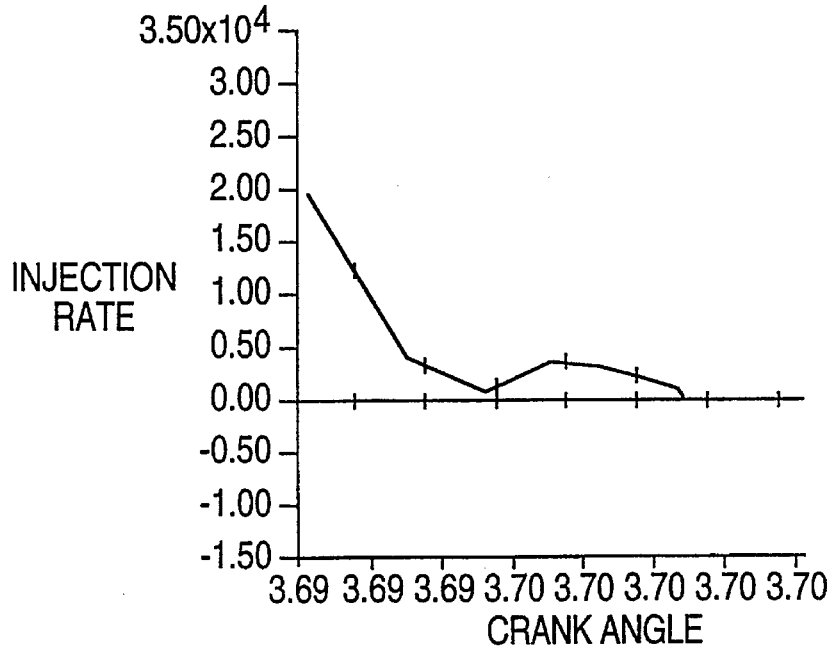
Figure 4E:
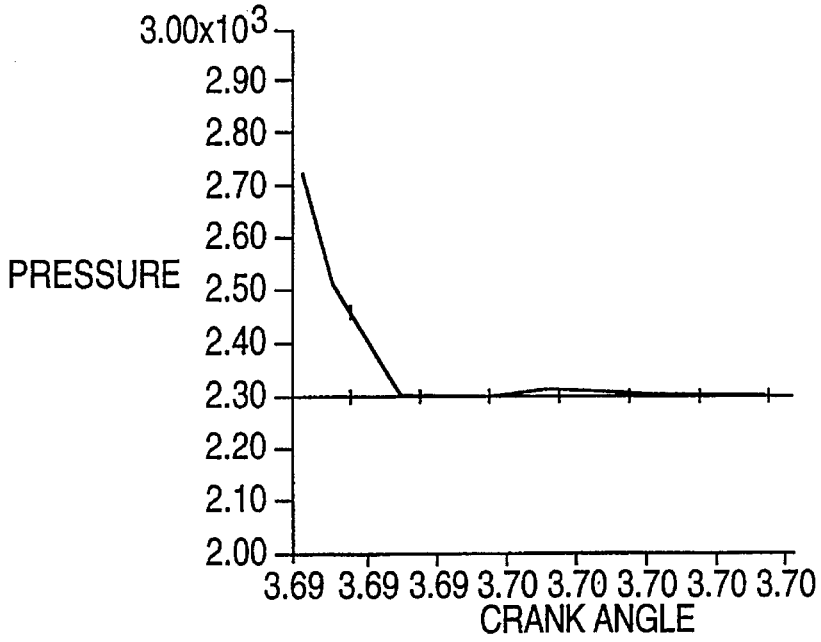
Figure 4F:
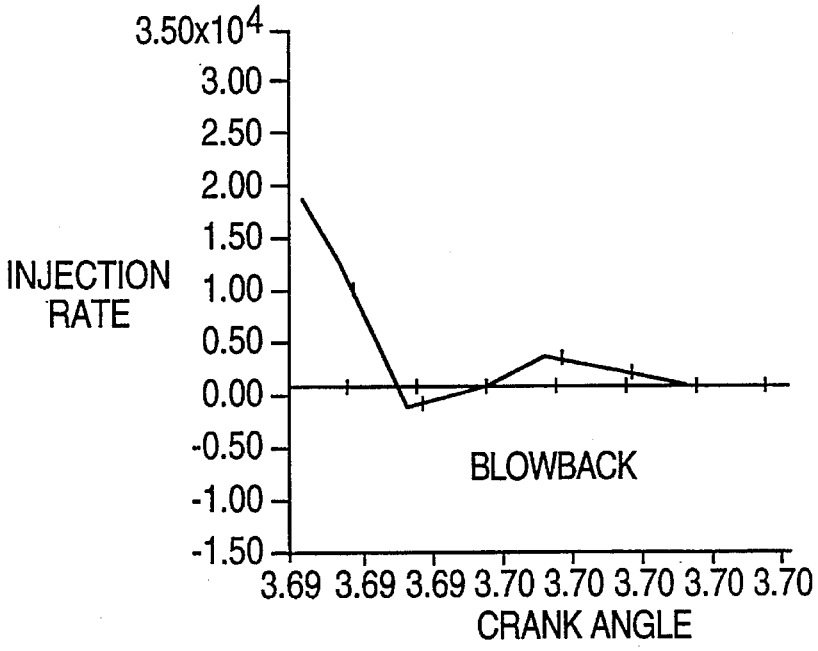

FIGS. 4*a*, 4*b*, 4*c*, 4*d*, 4*e* and 4*f* present, graphically, one of the advantages of forming the injector needle valve assembly of a ceramic material in accordance with the present invention. The upper graph in each of FIGS. 4*a*, 4*c* and 4*e* shows the relationship between pressure and crank angle, and the graph in each of FIGS. 4*b*, 4*d* and 4*f* sets forth the relationship between injection rate and crank angle. The data shown was obtained from numerical simulation at 1000 RPM and 150 $mm^3$ injected fuel quantity.

The needle and retainer element considered to generate the data in FIGS. 4*a* and 4*b* were assigned the material properties of a steel currently used for such structures. An injector metering chamber spill port (35 in FIG. 1) diameter of 0.029 inches was set. The needle and retainer elements considered to generate the data in FIGS. 4*c*–4*f* were assigned the properties of silicon nitride ceramic with a density 50% less than that of the steel material assigned to the needle and retainer elements considered for FIGS. 4*a* and 4*b*. Metering chamber spill port diameters of 0.041 inches and 0.042 inches were considered for FIGS. 4*c* and 4*d* and FIGS. 4*e* and 4*f*, respectively. Experience as well as simulation has shown that without the present invention gas blowback is a significant problem with these large port sizes. Consequently, current practice is to keep spill port diameters small, which retards the termination of injection. This simulation data demonstrates that forming the needle and retainer element of an advanced structural ceramic, such as silicon nitride, allows a larger injector spill port to be used without gas blowback.

Figure 5A:
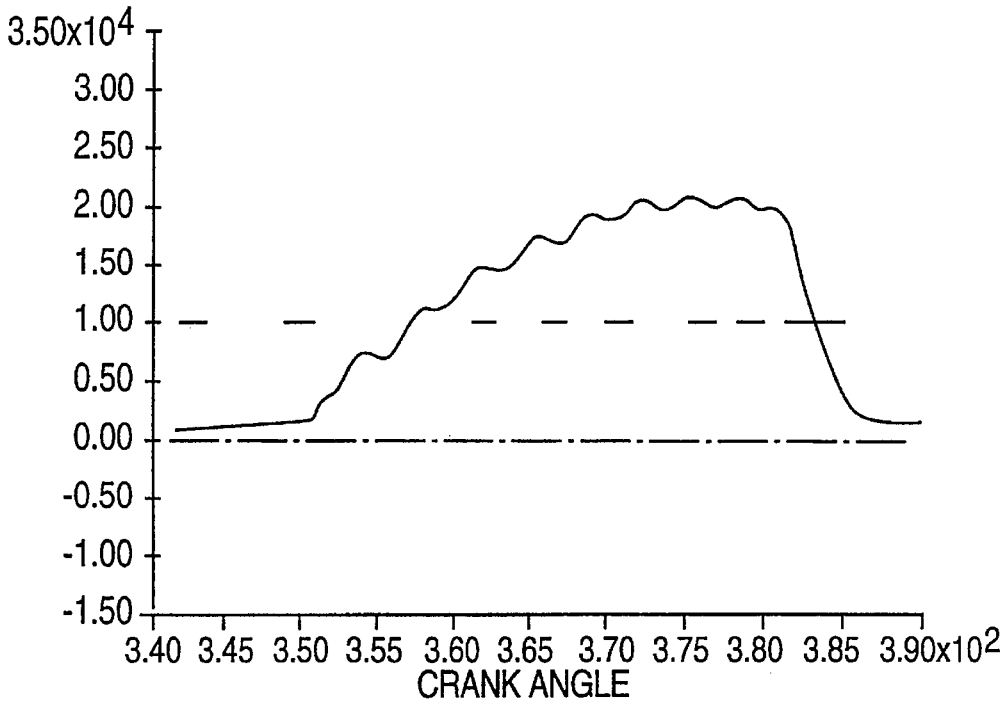
FIGS. 5*a* and 5*b* are graphic representations of the sharper end of injection possible with the injector needle valve of the present invention.
Figure 5B:
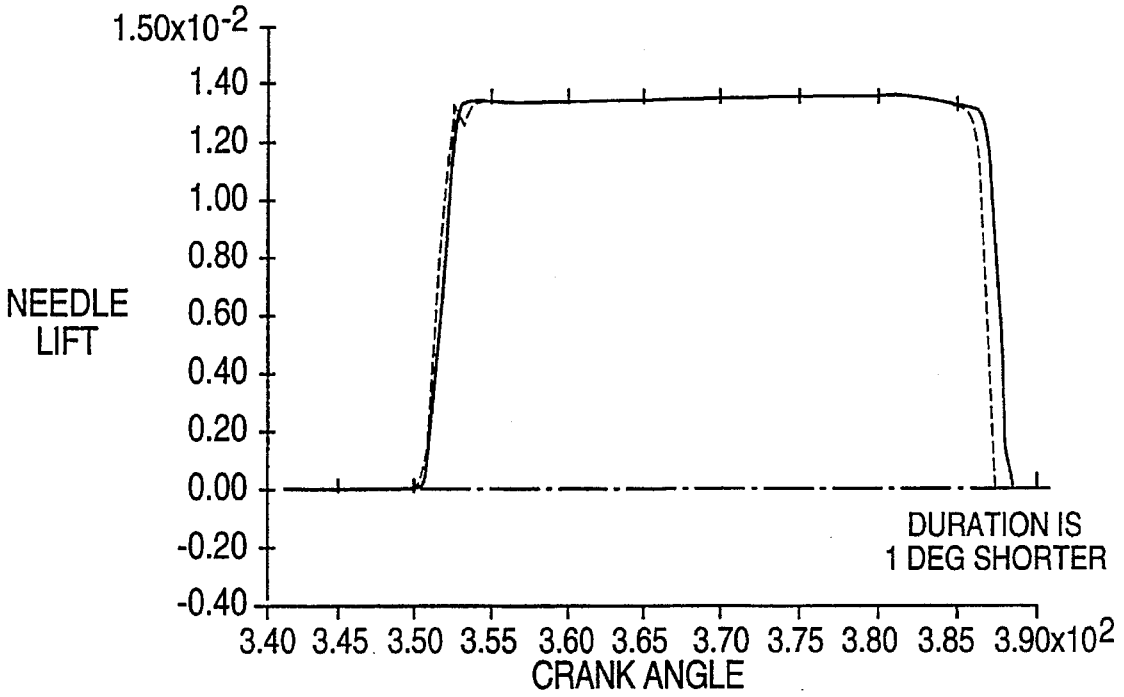

FIGS. 5*a* and 5*b* are graphic representations of the end of injection improvements expected with a closed nozzle fuel injector when the needle and retainer element are formed of an advanced structural ceramic like silicon nitride in accordance with the present invention. This data was obtained from simulations at 1800 RPM and 200 $mm^3$ injected fuel quantity.

FIG. 5*a* compares the quantity injected at the end of injection with the pressure less than 10 ksi. The data is presented for volumes of 8 $mm^3$ and 10 $mm^3$.

FIG. 5*b* predicts that the duration of the end of injection will be one degree of crank angle shorter with a ceramic needle valve assembly than with a steel assembly in the comparison of needle lift to crank angle shown in this graph. Once the injection pressure has dropped below a level where particulate and other exhaust emissions are satisfactorily controlled, the fuel injection can be quickly terminated with the ceramic needle valve assembly of the present invention.

Industrial Applicability

The low inertia, wear-resistant valve for a closed nozzle unit fuel injector of the present invention will find its primary applicability in an internal combustion engine fuel injection system that employs closed nozzle unit fuel injectors.

We claim:

1. A closed nozzle unit fuel injector for an internal combustion engine having improved fuel injection dynamic characteristics, wherein said injector includes a fuel discharge end with a fuel discharge nozzle tip which is blocked to prevent fuel flow therethrough and is opened to allow fuel flow therethrough when an injection event is initiated by the actuation of a needle valve assembly within an axial fuel channel in said nozzle tip during engine operation, wherein said needle valve assembly comprises:

(a) a longitudinal needle element configured and sized to reciprocate within the axial fuel channel between a fully seated position blocking fuel flow through the fuel discharge nozzle tip and an unseated position allowing fuel to flow through the fuel discharge nozzle tip, wherein said needle element includes a tip end complimentarily configured to fit said fuel discharge nozzle tip and a planar contact end oriented perpendicularly to the longitudinal axis of the needle element;

(b) a spring retainer element positioned axially away from said needle element tip end and adjacent to said planar contact end, wherein said spring retainer element includes a needle element contact portion positioned toward the needle element contact end, a smaller diameter spring retaining portion positioned axially away from the needle element, and an annular shoulder between said needle element contact portion and said spring retaining portion;

(c) a helical spring element in biasing contact with said annular shoulder and in retaining contact with said spring retaining portion, wherein said spring element biases said needle element in said fully seated position;

(d) a nib element having a smaller diameter than said needle element interposed axially between said needle element contact end and said retainer element contact portion, wherein said nib element is permanently secured to the contact end of the needle element or to the needle element contact portion of the retainer element; and (e) a valve seat surrounding the axial fuel flow channel in the fuel discharge nozzle tip, wherein said valve seat comprises a metal portion extending axially away from said fuel discharge nozzle tip toward said spring retainer element and a ceramic portion located adjacent to and axially inwardly of said metal portion, and said valve seat is configured to seat said needle element in said fully seated position.

2. The closed nozzle unit fuel injector described in claim 1, wherein said nib element is permanently secured to the planar contact end of said needle element so that said nib element contacts the needle element contact portion of said retainer element during the axial reciprocation of the needle valve assembly.

3. The closed nozzle unit fuel injector described in claim 1, wherein said nib element is permanently secured to the needle contact portion of said retainer element so that said nib element contacts the planar contact end of said needle element during the axial reciprocation of said needle valve assembly.

4. The closed nozzle unit fuel injector described in claim 1, wherein said needle element and said retainer element are formed from a low inertia, wear-resistant ceramic material.

5. The closed nozzle unit fuel injector described in claim 4, wherein said nib element is integrally formed with said needle element to project axially away from said needle element tip end and to contact said retainer element needle element contact portion.

6. The closed nozzle unit fuel injector described in claim 4, wherein said nib element is integrally formed with said retainer element to project axially away from said spring retaining portion and to contact said needle element planar contact end.

7. The closed nozzle unit fuel injector described in claim 4, wherein said needle element and said retainer element are formed from a silicon nitride ceramic.

8. The closed nozzle unit fuel injector described in claim 7, wherein said spring element is made of steel.

9. A low inertia, wear-resistant valve assembly for a closed nozzle unit fuel injector for an internal combustion engine wherein said injector includes an axial fuel flow channel in a fuel discharge end with a fuel discharge nozzle tip which is maintained in a closed condition to prevent fuel flow through the tip and is opened to allow fuel flow through the tip when an injection event is initiated during engine operation, said valve assembly comprising:

(a) a valve seat surrounding the axial fuel flow channel in the nozzle tip and comprising a metal seat portion extending axially away from the nozzle tip and a ceramic seat portion adjacent to and axially inwardly of said metal seat portion;

(b) a needle element configured to reciprocate axially within said fuel flow channel and to seat in the valve seat to block fuel flow through the nozzle tip, wherein said needle element is made of a low inertia, wear-resistant ceramic and includes a tip end configured to fit within and block fuel flow from said nozzle tip and a planar contact end with a contact surface perpendicular to the longitudinal axis of the needle element;

(c) a spring retainer element axially adjacent to said needle element planar contact end, wherein said spring retainer element is made of a low inertia, wear-resistant ceramic and includes a needle element contact end and a spring-receiving end sized and configured to receive and hold a helical biasing spring so that said spring biases said needle element toward said nozzle tip to block fuel flow therethrough; and (d) a nib element interposed axially between said needle element and said spring retainer element, wherein the nib element is permanently secured to the needle element planar contact end or to the spring retainer element needle element contact end.

10. The valve assembly described in claim 9, wherein said needle element and said retainer element are made of a silicon nitride ceramic.

11. The valve assembly described in claim 9, wherein the nib element has a smaller diameter than and is integrally formed with said needle element to project axially from the contact surface toward the spring retainer element.

12. The valve assembly described in claim 9, wherein the nib element has a smaller dimension than and is integrally formed with said spring retainer element to project axially away from the needle element contact end toward the needle element.

* * * * *